US007084698B2

(12) United States Patent
Khan et al.

(10) Patent No.: US 7,084,698 B2
(45) Date of Patent: Aug. 1, 2006

(54) BAND-GAP REFERENCE CIRCUIT

(75) Inventors: Qadeer A. Khan, New Delhi (IN); Sanjay K. Wadhwa, Gurgaon (IN); Kulbhushan Misri, Gurgaon (IN)

(73) Assignee: Freescale Semiconductor, Inc., Austin, TX (US)

( * ) Notice: Subject to any disclaimer, the term of this patent is extended or adjusted under 35 U.S.C. 154(b) by 99 days.

(21) Appl. No.: 10/964,793

(22) Filed: Oct. 14, 2004

(65) Prior Publication Data

US 2006/0082410 A1 Apr. 20, 2006

(51) Int. Cl.
*G05F 1/10* (2006.01)

(52) U.S. Cl. ..... 327/539; 327/513; 323/313

(58) Field of Classification Search ..... 323/312–315; 327/512–513, 539–541, 543
See application file for complete search history.

(56) References Cited

U.S. PATENT DOCUMENTS

| | | | | |
|---|---|---|---|---|
| 4,374,357 | A | 2/1983 | Olesin et al. | |
| 4,396,833 | A * | 8/1983 | Pan | 250/214 R |
| 4,978,868 | A | 12/1990 | Giordano et al. | |
| 5,408,174 | A * | 4/1995 | Leonowich | 323/315 |
| 5,760,639 | A | 6/1998 | Hall | |
| 6,016,051 | A | 1/2000 | Can | |
| 6,023,189 | A | 2/2000 | Seelbach | |
| 6,060,874 | A * | 5/2000 | Doorenbos | 323/316 |
| 6,111,397 | A * | 8/2000 | Leung | 323/315 |
| 6,160,391 | A | 12/2000 | Banba | |
| 6,191,637 | B1 * | 2/2001 | Lewicki et al. | 327/337 |
| 6,194,944 | B1 * | 2/2001 | Wert | 327/327 |
| 6,281,743 | B1 | 8/2001 | Doyle | |
| 6,356,066 | B1 | 3/2002 | Iliasevitch | |
| 6,366,071 | B1 | 4/2002 | Yu | |
| 6,407,622 | B1 | 6/2002 | Opris | |
| 6,426,669 | B1 | 7/2002 | Friedman et al. | |
| 6,531,857 | B1 | 3/2003 | Ju | |
| 6,563,371 | B1 | 5/2003 | Buckley et al. | |
| 6,577,302 | B1 * | 6/2003 | Hunter et al. | 345/204 |
| RE38,250 | E | 9/2003 | Slemmer | |
| 6,642,778 | B1 | 11/2003 | Opris | |
| 6,784,725 | B1 | 8/2004 | Wadhwa et al. | |
| 2003/0222706 | A1 | 12/2003 | Enriquez et al. | |
| 2004/0155700 | A1 * | 8/2004 | Gower et al. | 327/543 |
| 2006/0006858 | A1 * | 1/2006 | Chiu | 323/313 |

OTHER PUBLICATIONS

Ogey, H. and Aebischer, D., CMOS Current Reference Without Resistance, IEEE J. Solid-State Circuits, vol. 32, No. 7, pp. 1132-1135, Jul. 1997.

Torelli, G. and de la Plaza, M., Tracking Switched-Capacitor CMOS Currect Reference, IEE Proc. Circuit Devices Systems, vol. 145, No. 1, pp. 44-47, Feb. 1998.

(Continued)

*Primary Examiner*—Linh My Nguyen
*Assistant Examiner*—Thomas J. Hiltunen
(74) *Attorney, Agent, or Firm*—Charles Bergere

(57) ABSTRACT

A band-gap reference circuit for generation of voltages and currents independent of process, voltage, and temperature includes three inversely proportional to absolute temperature (IPTAT) current generators. The IPTAT current generators generate three currents that are added to generate a current independent of the absolute temperature. The generated current is passed through a switched capacitor resistor to generate the band-gap reference voltage across the switched capacitor resistor.

11 Claims, 5 Drawing Sheets

OTHER PUBLICATIONS

Malik, S.Q., Schlarmann, M.E., and Geiger, R.L., A Low Temperature Sensitivity Switched-Capacitor Current Reference, European Conference on Circuit Theory and Design, Espoo, Finaland, Aug. 28-31, 2001.

Khan, Q.A., Wadhwa, S.K., and Misri, K., A Low Voltage Switched-Capacitor Current Reference Circuit with Low Dependence on Process, Voltage and Temperature, $16_{th}$ International Conference on VLSI Design, New Delhi, India, Jun. 4-8, 2003.

* cited by examiner

BAND-GAP REFERENCE CIRCUIT

BACKGROUND OF THE INVENTION

The present invention relates generally to a reference circuit for the generation of a reference voltage and, in particular, to a band-gap reference circuit that generates voltages and currents independent of process, voltage, and temperature.

Band-gap reference circuits are used to generate precise voltages and currents. The generated voltages and currents are independent of process, voltage, and temperature. Band-gap reference circuits are used in various analogue and digital circuits that require precise voltages or currents for operation. In particular, the generated voltage is used as a bias voltage in circuits such as Analogue to Digital (A/D) converters and constant current generators. In conventional band-gap reference circuits, a reference voltage is generated across a resistor by passing a suitable current through the resistor.

Current generators are used for generating a current that enables generation of the required reference voltage across the resistor. Current generators usually include a Proportional to Absolute Temperature (PTAT) current generator, and an Inversely Proportional to Absolute Temperature (IPTAT) current generator. The PTAT current generator generates a current that is proportional to the absolute temperature, whereas the IPTAT current generator generates a current that is inversely proportional to the absolute temperature. The currents generated by these two current generators are added to generate a current that is independent of the absolute temperature. This generated current is then passed through a resistor and the required reference voltage is generated across the resistor.

In conventional band-gap reference circuits that use the Complementary Metal Oxide Semiconductor (CMOS) technology, good quality resistors are required for current generation. Such resistors require extra mask sets, which adds to the fabrication costs of the circuit. Further, conventional band-gap reference circuits are not suitable for generation of very low reference voltage levels, such as 1 Volt and lower. Hence, the conventional circuits cannot be used in circuits made with low voltage process technologies, such as CMOS90.

Accordingly, there is a need for a band-gap reference circuit that is suitable for generation of low operational voltage levels, and that may be readily fabricated at reasonable cost.

BRIEF DESCRIPTION OF THE DRAWINGS

The following detailed description of preferred embodiments of the invention will be better understood when read in conjunction with the appended drawings. The present invention is illustrated by way of example and not limited by the accompanying figures, in which like references indicate similar elements.

DETAILED DESCRIPTION OF THE INVENTION

The detailed description in connection with the appended drawings is intended as a description of the presently preferred embodiments of the invention, and is not intended to represent the only form in which the present invention may be practiced. It is to be understood that the same or equivalent functions may be accomplished by different embodiments that are intended to be encompassed within the spirit and scope of the invention.

The present invention provides a band-gap reference circuit for voltage and current generation. The band-gap reference circuit includes three inversely proportional to absolute temperature (IPTAT) current generators that generate three respective currents. The three generated currents are added to generate a current independent of the absolute temperature. This absolute temperature independent current is passed through a resistor to generate a band-gap reference voltage across the resistor. In one embodiment, the resistor is a switched capacitor resistor.

The band-gap reference circuit of the present invention is suitable for generation of very low reference voltage levels, such as 1V and lower. Further, the band-gap reference circuit of the present invention has a relatively low fabrication cost because it uses a combination of capacitors and transistors to implement the resistors used to generate the reference voltage.

Figure 1:
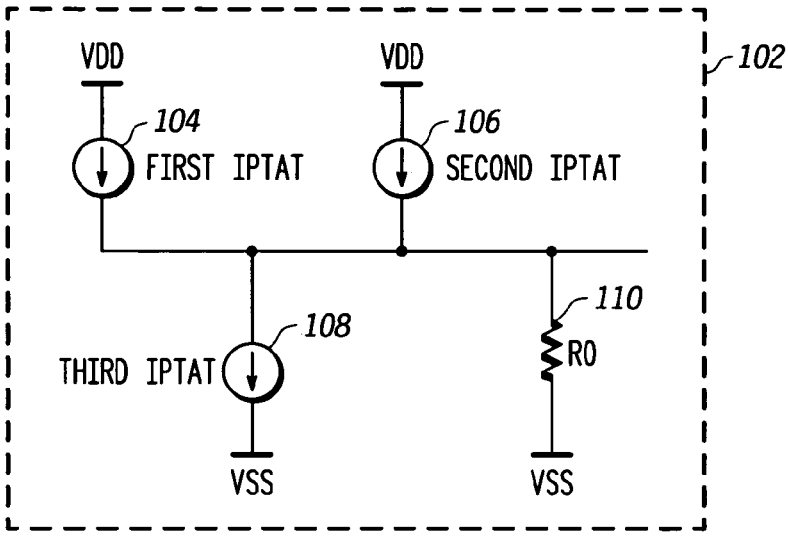
FIG. 1 is a high-level block diagram of a band-gap reference circuit in accordance with an exemplary embodiment of the present invention.

Referring now to FIG. 1, a block diagram of a band-gap reference circuit 102, in accordance with an exemplary embodiment of the present invention, is shown. The band-gap reference circuit 102 comprises a first IPTAT current generator 104, a second IPTAT current generator 106, a third IPTAT current generator 108, and a resistor 110. In one embodiment, the resistor 110 comprises a switched capacitor resistor, as discussed in more detail below.

The first IPTAT current generator 104 generates a first current. The second IPTAT current generator 106 is connected in parallel with the first IPTAT current generator 104 and generates a second current. The third IPTAT current generator 108 is connected in series with the first and second IPTAT current generators 104 and 106 and generates a third current. An exemplary circuit for implementing the IPTAT current generators 104, 106, and 108 is described in detail, in conjunction with FIG. 3.

The resistor 110 is connected in series with first and second IPTAT current generators 104 and 106 and in parallel with third IPTAT generator 108. As discussed in detail below, each of the first and second IPTAT current generators 104 and 106 includes a switched capacitor resistor.

In the band-gap reference circuit 102, the difference between the second and the third current generates a current that is Proportional to Absolute Temperature (PTAT). The first current generated by the first IPTAT 104 is added to a difference between the second and third currents, which generates an output current that passes through the resistor 110. A band-gap reference voltage is generated across the resistor 110 as a result of the output current passing through resistor 110. As discussed above, in one embodiment, the resistor 110 is a switched capacitor resistor. Such a switched capacitor resistor is described in detail, in conjunction with FIG. 2.

Figure 2:
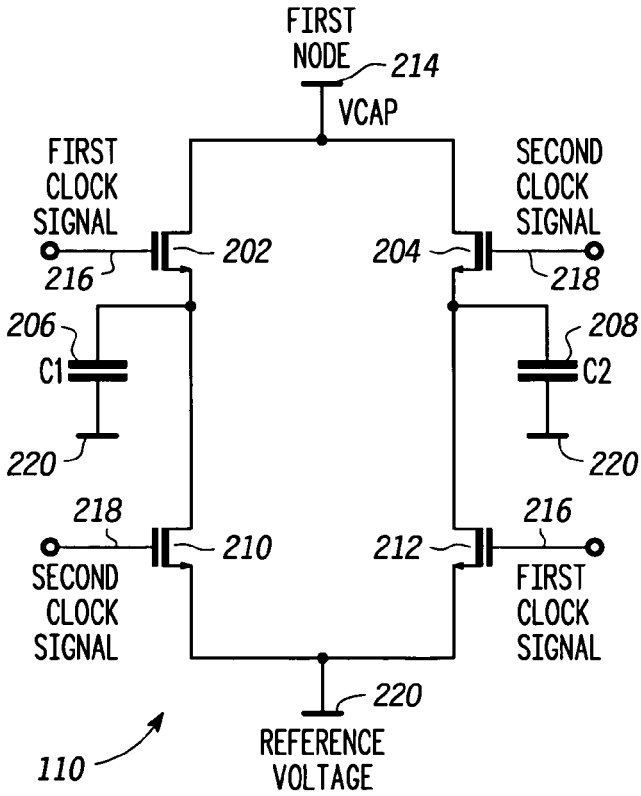
FIG. 2 is a schematic circuit diagram of a switched capacitor resistor in accordance with an exemplary embodiment of the present invention.

FIG. 2 is a schematic circuit diagram of the resistor 110 in accordance with an exemplary embodiment of the present invention. The resistor 110 is a switched capacitor resistor comprising a first NMOS transistor 202, a second NMOS transistor 204, a first capacitor 206, a second capacitor 208, a third NMOS transistor 210, and a fourth NMOS transistor 212. For the transistors shown and described hereinafter, unless mentioned otherwise, the bulks of the transistors are connected to their respective sources.

The first NMOS transistor 202 has a drain connected to a first node 214 at a voltage VCAP, a gate connected to a first clock signal 216, and a source. The second NMOS transistor 204 has a drain connected to the first node 214, a gate connected to a second clock signal 218, and a source. The third NMOS transistor 210 has a drain connected to the source of the first NMOS transistor 202, a gate connected to the second clock signal 218, and a source connected to a reference voltage 220. The fourth NMOS transistor 212 has a drain connected to the source of the second NMOS transistor 204, a gate connected to the first clock signal 216, and a source connected to the reference voltage 220. The first capacitor 206 has a first terminal connected to the source of the first NMOS transistor 202, and a second terminal connected to the reference voltage 220. The second capacitor 208 has a first terminal connected to the source of the second NMOS transistor 204, and a second terminal connected to the reference voltage 220.

In an embodiment of the present invention, the first and second clock signals 216 and 218 are non-overlapping clock signals. The first node 214 of the switched capacitor resistor 110 receives the output current, as described in conjunction with FIG. 1. As the first and second clock signals 216 and 218 are non-overlapping, the first and second NMOS transistors 202 and 204 are not switched ON simultaneously. Similarly, the first and third NMOS transistors 202 and 210 are not switched ON simultaneously. When the first NMOS transistor 202 is switched ON, the second and third NMOS transistors 204 and 210 are switched OFF. Such a switching pattern of the NMOS transistors ensures that the first and second capacitors 206 and 208 are charging and discharging, respectively, and vice-versa. When the first NMOS transistor 202 is ON, the first capacitor 206 is charging and the third NMOS transistor 210 is OFF. Similarly, the second NMOS transistor 204 is OFF and the fourth NMOS transistor 212 is ON, which discharges the second capacitor 208.

Similarly, when the second clock signal 218 is ON and the first clock signal 216 is OFF, the second and third NMOS transistors 204 and 210 are ON, and the first and fourth NMOS transistors 202 and 212 are OFF. As a result, the first capacitor 206 discharges and the second capacitor 208 charges.

In an embodiment of the present invention, the first and second capacitors 206 and 208 have the same capacitance value. The charging and discharging of the first and second capacitors 206 and 208 results in generating a resistive circuit, the resistance of which is calculated with the following equation:

$$R_{SC}=\tfrac{1}{2}CF_{clk}$$

where, $R_{SC}$ is the resistance of the switched capacitor resistor 110, C is the capacitance of the first and second capacitors 206 and 208, and $F_{clk}$ is the clock frequency of the first and second clock signals 216 and 218. Exemplary values used in the present invention are a supply voltage=1.5 v, reference voltage=0 v, frequency of the clock signal=10 MHz, capacitors used in switched capacitor resistors=1.6 pF, and decoupling capacitors=13 pF.

Figure 3:
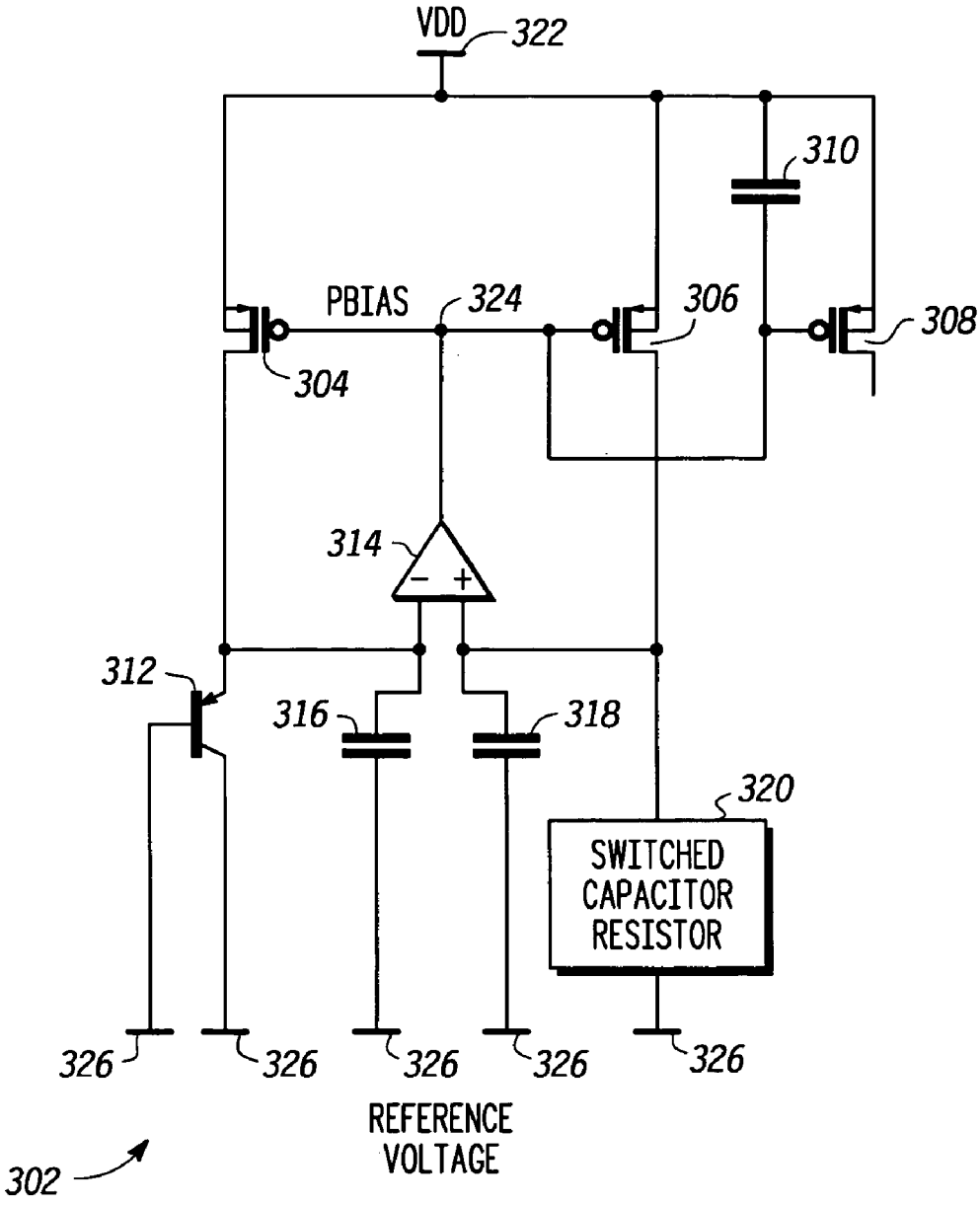
FIG. 3 is a schematic circuit diagram of an IPTAT current generator in accordance with an exemplary embodiment of the present invention.

FIG. 3 is a schematic circuit diagram of an IPTAT current generator 302, in accordance with an exemplary embodiment of the present invention. The IPTAT current generator 302 comprises a first PMOS transistor 304, a second PMOS transistor 306, a third PMOS transistor 308, a third capacitor 310, a PNP transistor 312, a comparator circuit 314, a fourth capacitor 316, a fifth capacitor 318, and a switched capacitor resistor 320.

The first PMOS transistor 304 has a source connected to a supply voltage (VDD) 322, a drain and a gate. The second PMOS transistor 306 has a source connected to the supply voltage 322, a gate connected to the gate of the first PMOS transistor 304 at a PBIAS node 324, and a drain. The third PMOS transistor 308 has a source connected to the supply voltage 322, a gate connected to the gate of the second PMOS transistor 306 at the PBIAS node 324, and a drain.

The third capacitor 310 has a first terminal connected to the supply voltage 322, and a second terminal connected to the gate of the third PMOS transistor 308. The PNP transistor 312 has an emitter connected to the drain of the first PMOS transistor 304, a base connected to a reference voltage 326, and a collector connected to the reference voltage 326. The comparator circuit 314 has a first input coupled to the emitter of the PNP transistor 312, a second input coupled to the drain of the second PMOS transistor 306, and an output connected to the gates of the first and second PMOS transistors 304 and 306 at the PBIAS node 324. In an embodiment of the present invention, the comparator circuit 314 is implemented with a differential amplifier. The output of the comparator circuit 314 provides a bias voltage to the first, second, and third PMOS transistors 304, 306, and 308.

The fourth capacitor 316 has a first terminal connected to the emitter of the PNP transistor 312, and a second terminal connected to the reference voltage 326. The fifth capacitor 318 has a first terminal connected to the drain of the second PMOS transistor 306, and a second terminal connected to the reference voltage 326. The third, fourth, and fifth capacitors 310, 316, and 318 are used as de-coupling capacitors to filter out ripples due to the switching in the switched capacitor resistor 230.

The switched capacitor resistor 320 has a first node connected to the drain of the second PMOS transistor 306, and a second node connected to the reference voltage 326. In one embodiment, the switched capacitor resistor 320 is implemented using a circuit the same as or similar to the switched capacitor resistor 110.

The IPTAT current generator 302 generates a current, which is inversely proportional to absolute temperature. The current generated by the IPTAT current generator 302 is drawn from the drain of the third PMOS transistor 308. The value of the current generated is dependent on the required and/or desired band-gap reference voltage and is controlled by an appropriate selection of values of the capacitors, supply voltage, and resistance value of the switched capacitor resistor 320. It is to be noted that each of the IPTAT current generators 104, 106, and 108 can be implemented using a circuit the same as or similar to the IPTAT current generator 302.

Figure 4:
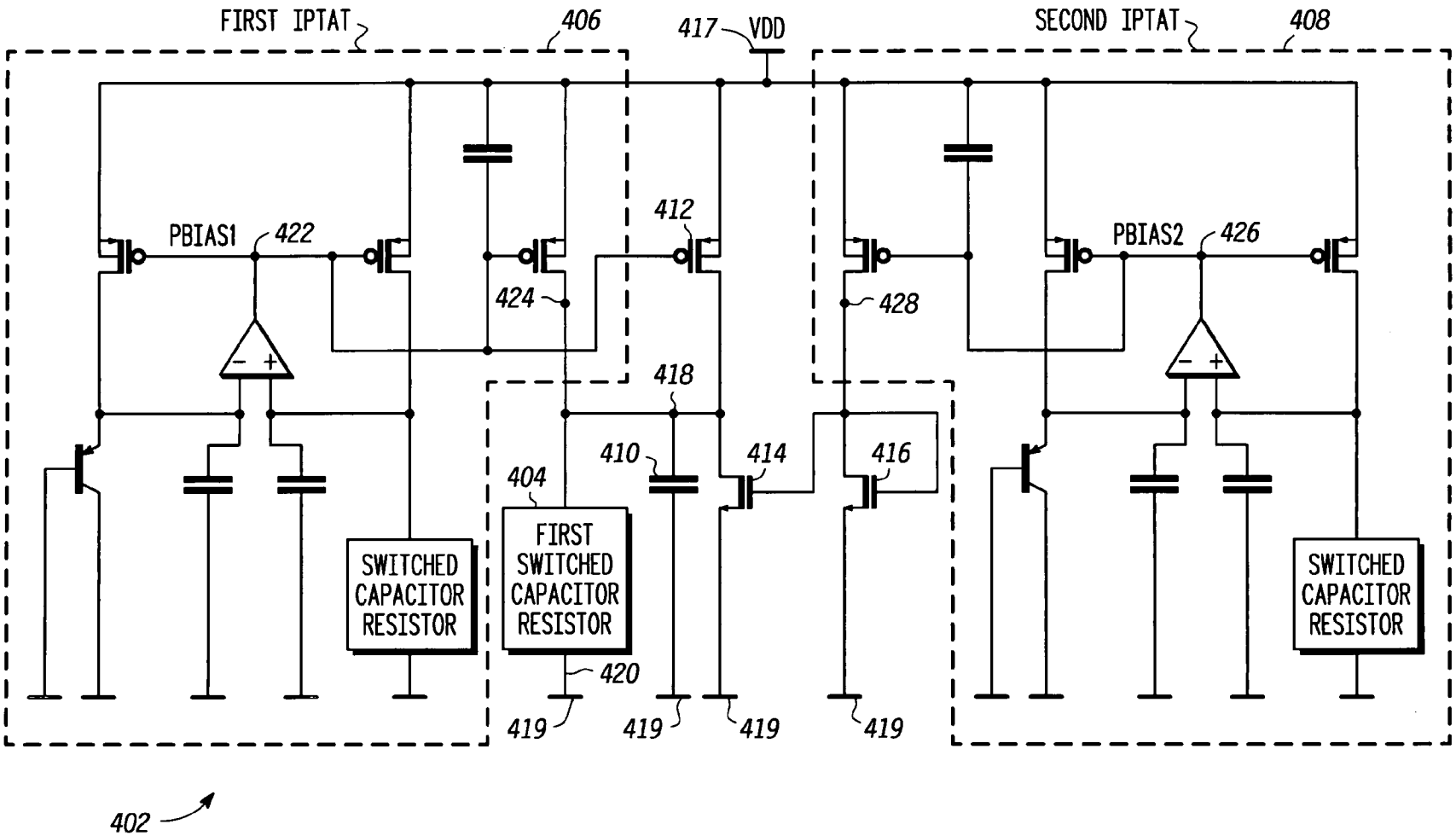
FIG. 4 is a schematic circuit diagram of a band-gap reference circuit in accordance with an exemplary embodiment of the present invention.

FIG. 4 is a schematic circuit diagram of a band-gap reference circuit 402, in accordance with an exemplary embodiment of the present invention. The band-gap reference circuit 402 comprises a first switched capacitor resistor 404, a first IPTAT current generator 406, a second IPTAT current generator 408, a first capacitor 410, a PMOS transistor 412, a first NMOS transistor 414, and a second NMOS transistor 416.

The first switched capacitor resistor 404 has a first node 418, and a second node 420 connected to a reference voltage 419. The first IPTAT current generator 406 has a first bias voltage at a first PBIAS node 422, and a first output node 424 connected to the first node 418. The second IPTAT current generator 408 has a second bias voltage at a second PBIAS node 426 and a second output node 428.

The first capacitor 410 has a first terminal connected to the first node 418, and a second terminal connected to the reference voltage 419. The PMOS transistor 412 has a source connected to a supply voltage (VDD) 417, a gate connected to the first PBIAS node 422, and a drain connected to the first terminal of the first capacitor 410.

The first NMOS transistor 414 has a drain connected to the drain of the PMOS transistor 412 at the first node 418, a source connected to the reference voltage 419, and a gate. The second NMOS transistor 416 has a gate connected to the gate of the first NMOS transistor 414, a source connected to the reference voltage 419, and a drain connected to the second output node 428 and to the gate of the first NMOS transistor 414.

A first output current is generated by the first IPTAT current generator 406, which is drawn from the first output node 424. A second output current is generated by the second IPTAT current generator 408, which is drawn from the second output node 428. The band-gap reference voltage is generated at the first node 418.

In an embodiment of the present invention, the IPTAT current generators 406 and 408 are similar to the IPTAT current generator 302. In an embodiment of the present invention, the first switched capacitor resistor 404 and the switched capacitor resistors used in the IPTAT current generators 406 and 408 are similar to the switched capacitor resistor shown in FIG. 2. The values of the supply voltage, sizes of transistors, PMOS transistors used in band-gap reference circuit 402, first switched capacitor resistor 404, and the switched capacitor resistors used in the IPTAT current generators 406 and 408 are selected, depending upon the band-gap reference voltage to be generated.

The band-gap reference circuit 402 also may be used to generate precise currents. In an embodiment of the present invention, a current reference circuit is implemented with a band-gap reference circuit similar to the band-gap reference circuit 402.

Figure 5:
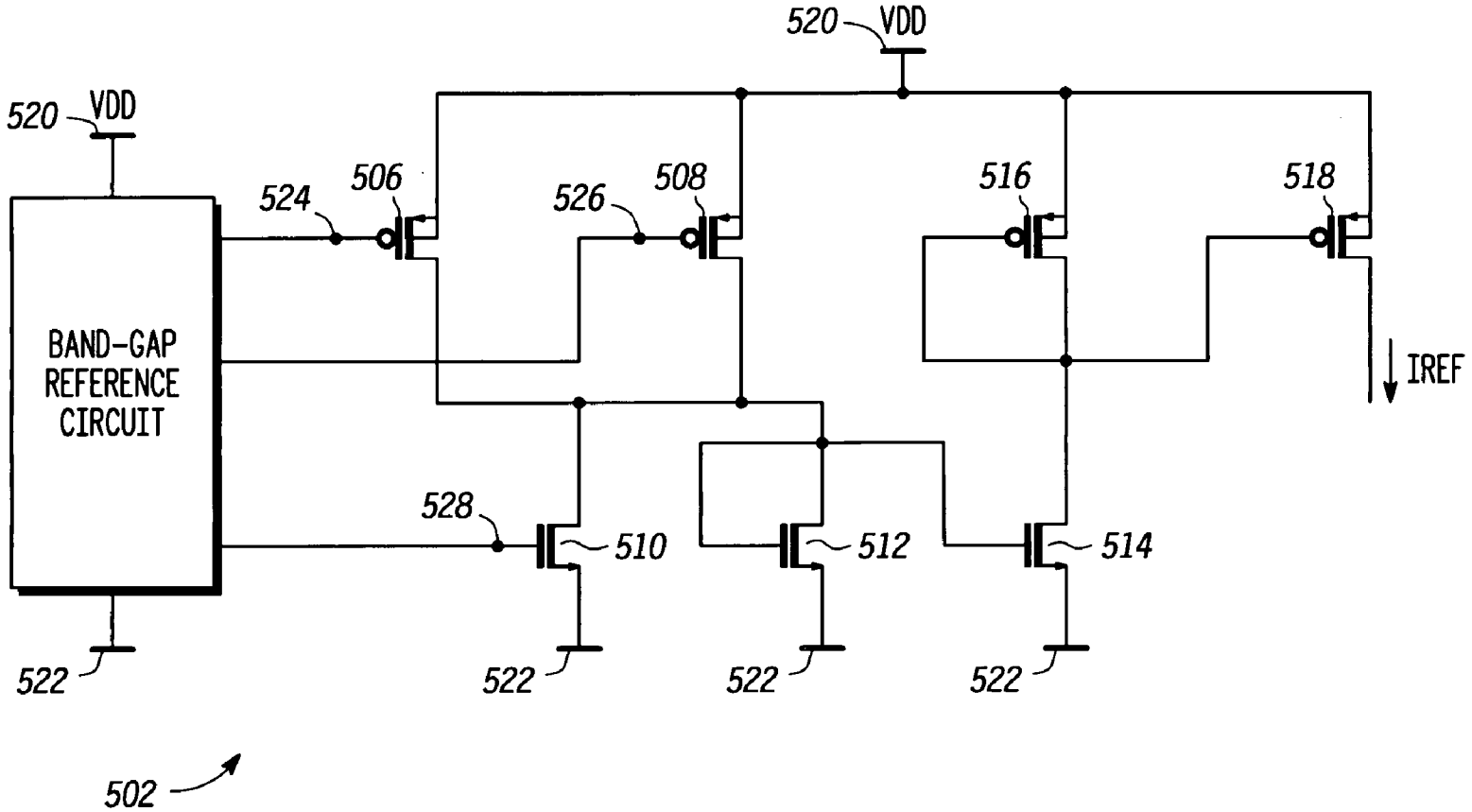
FIG. 5 is a schematic circuit diagram of a current reference circuit in accordance with an exemplary embodiment of the present invention.

FIG. 5 is a schematic circuit diagram of a current reference circuit 502, in accordance with an exemplary embodiment of the present invention. The current reference circuit 502 comprises a band-gap reference circuit 504, a first PMOS transistor 506, a second PMOS transistor 508, a first NMOS transistor 510, a second NMOS transistor 512, a third NMOS transistor 514, a third PMOS transistor 516, and a fourth PMOS transistor 518.

The band-gap reference circuit 504 is connected between a supply voltage (VDD) 520 and a reference voltage 522. The band-gap reference circuit 504 generates a first bias voltage at a first PBIAS node 524, a second bias voltage at a second PBIAS node 526, and a third bias voltage at a NBIAS node 528. According to the present invention, the band-gap reference circuit 504 includes at least one switched capacitor resistor.

The first PMOS transistor 506 has a source connected to the supply voltage 520, a gate connected to the first PBIAS node 524, and a drain. The second PMOS transistor 508 has a source connected to the supply voltage 520, a gate connected to the second PBIAS node 526, and a drain connected to the drain of the first PMOS transistor 506. The first NMOS transistor 510 has a gate connected to the NBIAS node 528, a drain connected to the drain of the first PMOS transistor 506, and a source connected to the reference voltage 522. The second NMOS transistor 512 has a drain and a gate connected to the drain of the first PMOS transistor 506, and a source connected to the reference voltage 522. The third NMOS transistor 514 has a gate connected to the drain of the first PMOS transistor 506, a source connected to the reference voltage 522, and a drain. The third PMOS transistor 516 has a source connected to the supply voltage 520, and a drain and a gate connected to the drain of the third NMOS transistor 514. The fourth PMOS transistor 518 has a source connected to the supply voltage 520, a gate connected to the gate of the third PMOS transistor 516, and a drain. The reference current (IREF) is drawn from the drain of the fourth PMOS transistor 518.

Figure 6:
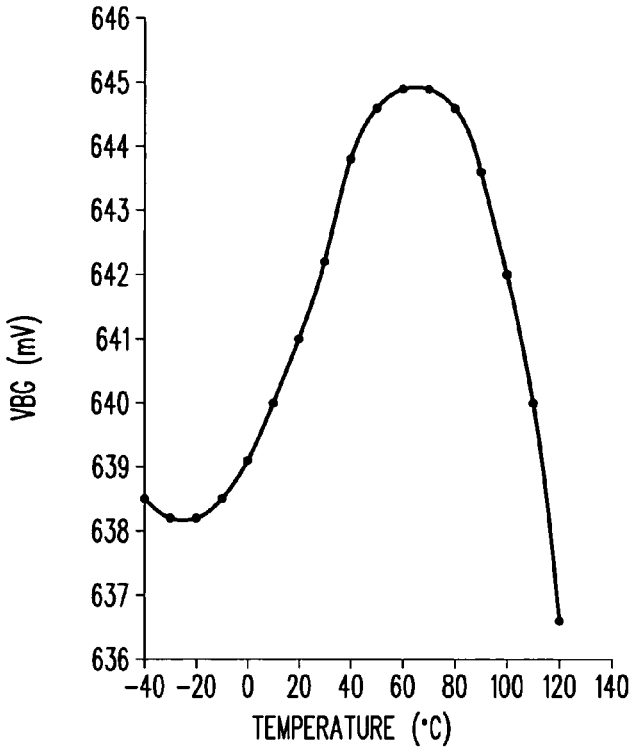
FIG. 6 is a graph illustrating variations in a band-gap reference voltage with respect to temperature, in accordance with an exemplary embodiment of the present invention.

FIG. 6 is a graph showing a variation in the band-gap reference voltage (VBG) with respect to the temperature, in accordance with an exemplary embodiment of the present invention. FIG. 6 depicts the behavior of VBG when the temperature is varied from −40° C. to 120° C. As shown in the graph, the VBG has a value of 638.5 mV at −40° C. and 637 mV at 120° C. with a peak of about 645 mV at 60° C. This variation in VBG with change in temperature is negligible.

Figure 7:
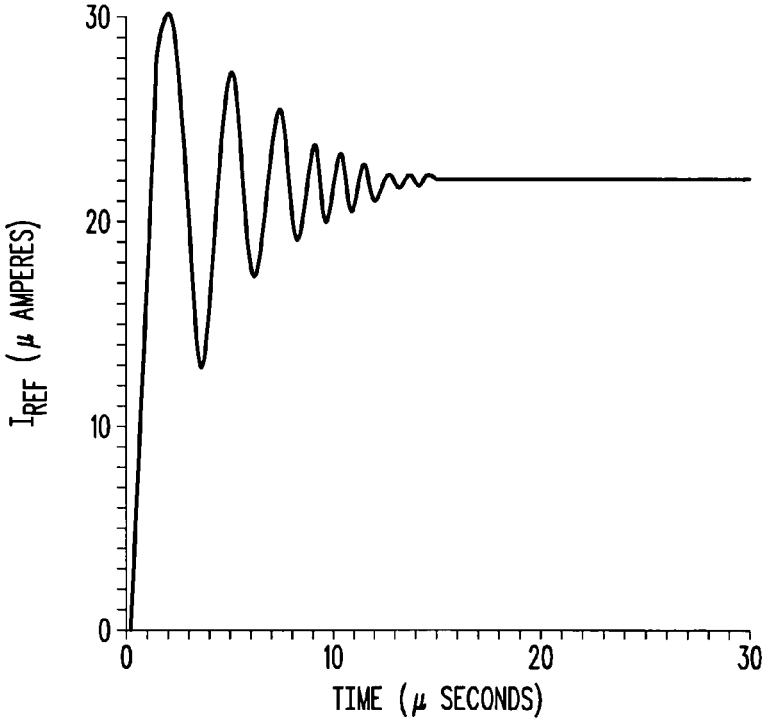
FIG. 7 is a graph illustrating a transient response of the current reference circuit in accordance with an exemplary embodiment of the present invention.

FIG. 7 is a graph illustrating a transient response of the reference current generated by the current reference circuit 502, in accordance with an exemplary embodiment of the present invention. As shown in the graph, the reference current generated at the drain of the fourth PMOS transistor 518 stabilizes in less than 20 usec.

While the various embodiments of the invention have been illustrated and described, it will be clear that the invention is not limited to these embodiments only. Numerous modifications, changes, variations, substitutions, and equivalents will be apparent to those skilled in the art, without departing from the spirit and scope of the invention, as described in the claims.

The invention claimed is:

1. A band-gap reference circuit that generates a band-gap reference voltage, the band-gap reference circuit comprising:

a first inversely proportional to absolute temperature (IPTAT) current generator that generates a first current; a second IPTAT current generator, connected in parallel with the first IPTAT current generator, that generates a second current;

a third IPTAT current generator, connected in series with the first IPTAT current generator, that generates a third current; and a resistor, connected in series with the first and second IPTAT current generators and in parallel with the third IPTAT generator, wherein the band-gap reference voltage is generated across the resistor, wherein each of the first, second, and third IPTAT current generators comprises:

a first PMOS transistor having a source connected to a supply voltage, a drain and a gate;

a second PMOS transistor having a source connected to the supply voltage, a gate connected to the gate of the first PMOS transistor at a PBIAS node, and a drain;

a third PMOS transistor having a source connected to the supply voltage, a gate connected to the gate of the second PMOS transistor at the PBIAS node, and a drain from which the current generated by the IPTAT is drawn;

a third capacitor having a first terminal connected to the supply voltage, and a second terminal connected to the gate of the third PMOS transistor;

a PNP transistor having an emitter connected to the drain of the first PMOS transistor, a base connected to a reference voltage, and a collector connected to the reference voltage;

a comparator circuit having a first input coupled to the emitter of the PNP transistor, a second input coupled to the drain of the second PMOS transistor, and an output connected to the gates of the first and second PMOS transistors at the PBIAS node, the output providing a bias voltage to the first, second, and third PMOS transistors;

a fourth capacitor having a first terminal connected to the emitter of the PNP transistor, and a second terminal connected to the reference voltage;

a fifth capacitor having a first terminal connected to the drain of the second PMOS transistor, and a second terminal connected to the reference voltage; and a switched capacitor resistor having a first node connected to the drain of the second PMOS transistor, and a second node connected to the reference voltage.

2. The band-gap reference circuit of claim 1, wherein an output current that passes through the resistor comprises the first current and a difference between the second and third currents.

3. The band-gap reference circuit of claim 1, wherein the resistor comprises a switched capacitor resistor.

4. The band-gap reference circuit of claim 3, wherein the switched capacitor resistor comprises:

a first NMOS transistor having a drain connected to a first node at a voltage VCAP, a gate connected to a first clock signal, and a source, the first node receiving the output current;

a second NMOS transistor having a drain connected to the first node, a gate connected to a second clock signal, and a source;

a third NMOS transistor having a drain connected to the source of the first NMOS transistor, a gate connected to the second clock signal, and a source connected to a reference voltage;

a fourth NMOS transistor having a drain connected to the source of the second NMOS transistor, a gate connected to the first clock signal, and a source connected to the reference voltage;

a first capacitor having a first terminal connected to the source of the first NMOS transistor, and a second terminal connected to the reference voltage; and a second capacitor having a first terminal connected to the source of the second NMOS transistor, and a second terminal connected to the reference voltage.

5. The band-gap reference circuit of claim 4, wherein the first clock and the second clock signals are non-overlapping clock signals.

6. The band-gap reference circuit of claim 1, wherein the switched capacitor resistor comprises:

a first NMOS transistor having a drain connected to a first node at a voltage VCAP, a gate connected to a first clock signal, and a source, the first node receiving the output current;

a second NMOS transistor having a drain connected to the first node, a gate connected to a second clock signal, and a source;

a third NMOS transistor having a drain connected to the source of the first NMOS transistor, a gate connected to the second clock signal, and a source connected to a reference voltage;

a fourth NMOS transistor having a drain connected to the source of the second NMOS transistor, a gate connected to the first clock signal, and a source connected to the reference voltage;

a first capacitor having a first terminal connected to the source of the first NMOS transistor, and a second terminal connected to the reference voltage; and a second capacitor having a first terminal connected to the source of the second NMOS transistor, and a second terminal connected to the reference voltage.

7. A band-gap reference circuit that generates a band-gap reference voltage the band-gap circuit comprising:

a first switched capacitor resistor having a first node at which the band-gap reference voltage is generated, and a second node connected to a reference voltage;

a first inversely proportional to absolute temperature (IPTAT) current generator having a first bias voltage at a first PBIAS node, and a first output node connected to the first node of the first switched capacitor, wherein a first output current generated by the first IPTAT current generator is drawn from the first output node;

a second IPTAT current generator having a second bias voltage at a second PBIAS node, and a second output node, wherein a second output current generated by the second IPTAT current generator is drawn from the second output node;

a first capacitor having a first terminal connected to the first output node, and a second terminal connected to the reference voltage;

a PMOS transistor having a source connected supply voltage, a gate connected to the first PBIAS node, and a drain connected to the first terminal of the first capacitor;

a first NMOS transistor having a drain connected to connected to the drain of the PMOS transistor, a source connected to the reference voltage, and a gate; and a second NMOS transistor having a gate connected to the gate of the first NMOS transistor, a source connected to the reference voltage, and a drain connected to the second output node and to the gate of the first NMOS transistor, wherein the first IPTAT current generator comprises:

a first PMOS transistor having a source connected to the supply voltage, a gate connected to the first PBIAS node, and a drain;

a second PMOS transistor having a source connected to the supply voltage, a gate connected to the gate of the first PMOS transistor and a drain;

a third PMOS transistor having a source connected to the supply voltage, a gate connected to the gate of the second PMOS transistor, and a drain connected to the first output node;

a fourth capacitor having a first terminal connected to the supply voltage, and a second terminal connected to the gate of the third PMOS transistor;

a first PNP transistor having an emitter connected to a drain of the first PMOS transistor, a base connected to the reference voltage, and a collector connected to the reference voltage:

a first comparator circuit having an input coupled to the emitter of the first PNP transistor, second input coupled to the drain of the second PMOS transistor, and an output connected to the gates of the first and second PMOS transistors;

a fifth capacitor having a first terminal connected to the emitter of the first PNP transistor, and a second terminal connected to the reference voltage; and a sixth capacitor having a first terminal connected to a drain of the second PMOS transistor, and a second terminal connected to the reference voltage; and a second switched capacitor resistor having a first node connected to the drain of the second PMOS transistor, and a second node connected to the reference voltage.

8. The band-gap reference circuit of claim 7, wherein the first switched capacitor resistor comprises:

a third NMOS transistor having a drain connected to the first node, a gate connected to a first clock signal, and a source;

a fourth NMOS transistor having a drain connected to the first node, a gate connected to a second clock signal, and a source;

a fifth NMOS transistor having a drain connected to the source of the third NMOS transistor, a gate connected to the second clock signal, and a source connected to the reference voltage;

a sixth NMOS transistor having a drain connected to the source of the fourth NMOS transistor, a gate connected to the first clock signal, and a source connected to the reference voltage;

a second capacitor having a first terminal connected to the source of the third NMOS transistor, and a second terminal connected to the reference voltage; and a third capacitor having a first terminal connected to the source of the fourth NMOS transistor, and a second terminal connected to the reference voltage.

9. The band-gap reference circuit of claim 7, wherein the first clock signal and the second clock signal are non-overlapping clock signals.

10. The band-gap reference circuit of claim 7, wherein the second IPTAT current generator comprises:

a fourth PMOS transistor having a source connected to the supply voltage, a gate connected to the second PBIAS node, and a drain;

a fifth PMOS transistor having a source connected to the supply voltage, a gate connected to the gate of the fourth PMOS transistor and a drain;

a sixth PMOS transistor having a source connected to the supply voltage, a gate connected to the gate of the fifth PMOS transistor, and a drain connected to the first output node;

a seventh capacitor having a first terminal connected to the supply voltage, and a second terminal connected to the gate of the sixth PMOS transistor;

a second PNP transistor having an emitter connected to a drain of the fourth PMOS transistor, a base connected to the reference voltage, and a collector connected to the reference voltage;

a second comparator circuit having an input coupled to the emitter of the second PNP transistor, second input coupled to the drain of the fifth PMOS transistor, and an output connected to the gates of the fourth and fifth PMOS transistors;

an eighth capacitor having a first terminal connected to the emitter of the second PNP transistor, and a second terminal connected to the reference voltage; and a ninth capacitor having a first terminal connected to a drain of the fifth PMOS transistor, and a second terminal connected to the reference voltage; and a third switched capacitor resistor having a first node connected to the drain of the fifth PMOS transistor, and a second node connected to the reference voltage.

11. A current reference circuit that generates a reference current, the current reference circuit comprising:

a band-gap reference circuit connected between a supply voltage and a reference voltage, the band-gap reference circuit generating a first bias voltage at a first PBIAS node, a second bias voltage at a second PBIAS node, and a third bias voltage at an NBIAS node, the band-gap reference circuit including at least one switched capacitor resistor, the band-gap reference circuit generating a band-gap reference voltage;

a first PMOS transistor having a source connected to the supply voltage, a gate connected to the first PBIAS node, and a drain;

a second PMOS transistor having a source connected to the supply voltage, a gate connected to the second PBIAS node, and a drain connected to the drain of the first PMOS transistor;

a first NMOS transistor having a gate connected to the NBIAS node, a drain connected to the drain of the first PMOS transistor and a source connected to the reference voltage;

a second NMOS transistor having a drain and a gate connected to the drain of the first PMOS transistor, and a source connected to the reference voltage;

a third NMOS transistor having a gate connected to the drain of the first PMOS transistor, a source connected to the reference voltage, and a drain;

a third PMOS transistor having a source connected to the supply voltage, and a drain and a gate connected to the drain of the third NMOS transistor; and a fourth PMOS transistor having a source connected to the supply voltage, a gate connected to the gate of the third PMOS transistor, and a drain from current is drawn.

* * * * *